US010617598B2

(12) United States Patent
Hirohata et al.

(10) Patent No.: US 10,617,598 B2
(45) Date of Patent: Apr. 14, 2020

(54) APPARATUS FOR LOADING VIBRATION

(75) Inventors: Kenji Hirohata, Tokyo (JP); Junichiro Ooga, Kanagawa-ken (JP); Takuya Hongo, Kanagawa-ken (JP); Yousuke Hisakuni, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 464 days.

(21) Appl. No.: 13/616,364

(22) Filed: Sep. 14, 2012

(65) Prior Publication Data

US 2013/0245513 A1 Sep. 19, 2013

(30) Foreign Application Priority Data

Mar. 19, 2012 (JP) ..... 2012-062848

(51) Int. Cl.
*A61H 23/02* (2006.01)

(52) U.S. Cl.
CPC . *A61H 23/0245* (2013.01); *A61H 2201/0146* (2013.01); *A61H 2201/0149* (2013.01); *A61H 2201/1638* (2013.01); *A61H 2201/5002* (2013.01); *A61H 2201/5005* (2013.01); *A61H 2230/065* (2013.01); *A61H 2230/305* (2013.01)

(58) Field of Classification Search
None
See application file for complete search history.

(56) References Cited

U.S. PATENT DOCUMENTS

2003/0009119 A1* 1/2003 Kamm et al. ..... 601/149
2005/0159690 A1* 7/2005 Barak et al. ..... 601/149
2009/0062884 A1* 3/2009 Endo et al. ..... 607/49
2011/0015790 A1* 1/2011 Yamakawa et al. ..... 700/280
2012/0220905 A1* 8/2012 Avni ..... 601/2

FOREIGN PATENT DOCUMENTS

JP 06-296704 10/1994
JP 2005-341989 12/2005
JP 4627379 11/2010

OTHER PUBLICATIONS

Letty et al, Valves Based on Amplified Piezoelectric Actuators, Jun. 2002, 8th International Conference on New Actuators, pp. 141-144 <http://www.cedrat-technologies.com/fileadmin/user_upload/cedrat_groupe/Publications/Publications/2002/06/Actuator2002_A4-6_VALVES-BASED-ON-AMPLIFIED-PIEZOELECTRIC-ACTUATORS.pdf>.*

(Continued)

*Primary Examiner* — Dennis W Ruhl
(74) *Attorney, Agent, or Firm* — Amin, Turocy & Watson, LLP

(57) ABSTRACT

According to one embodiment, an apparatus for loading vibration is provided. The apparatus for loading vibration has a contacting unit, a first vibration unit, a storage unit and a control unit. The contacting unit is capable of coming into contact with a biological body which pulsates or beats in a contact state of a first contact condition. The first vibration unit provides a self-excited vibration to the biological body through the contacting unit. The storage unit stores a second contact condition which synchronizes the self-excited vibration with the pulses or the beats. The control unit controls the contact state of the contacting unit so as to make the first contact condition become closer to the second contact condition.

26 Claims, 6 Drawing Sheets

(56) References Cited

OTHER PUBLICATIONS

Japanese Office Action for Japanese Application No. 2012-062848 dated May 9, 2014.
Azuma, Yuji, et al.; "a van der Pol-type Self-Excited Cantilever by Integral Controller", Transaction of the Japan Society of Mechanical Engineers, Series C, vol. 76, No. 765.
Manohar, et al., Entrainment in Van Der Pol's Oscillator in the Presence of Noise, Int. J. Non-Linear Mechanics, vol. 26, No. 5, pp. 679-686, 1991, Great Britain.
Ding, Self-Excited Vibration, Theory, Paradigms, and Research Methods, 2010.
Dewan, Harmonic Entrainment of van der Pol Oscillations: Phaselocking and Asynchronous Quenching, IEEE Transactions on Automatic Control, vol. ac-17, No. 5, Oct. 1972.

* cited by examiner

APPARATUS FOR LOADING VIBRATION

This application is based upon and claims the benefit of priority from the prior Japanese Patent Application No. 2012-62848, filed on Mar. 19, 2012, the entire contents of which are incorporated herein by reference.

FIELD

Embodiments described herein relate generally to an apparatus for loading vibration.

BACKGROUND

A mechanical behavior of tissues inside a biological body such as a headache, a bedsore or a pulmonary thromboembolism may be a cause of decreasing a biological function inside the biological body. The headache is caused, when a pulse displacement of blood vessels becomes larger than that caused under a nor mal condition and the adjacent nerves are irritated. The bedsore and the pulmonary thromboembolism (an economy class syndrome) are caused when blood flow in the blood vessels is restricted by a continued load.

A technique for preventing such decrease of a biological function caused by a mechanical behavior of tissues inside a biological body is desired.

DETAILED DESCRIPTION

Figure 1A:
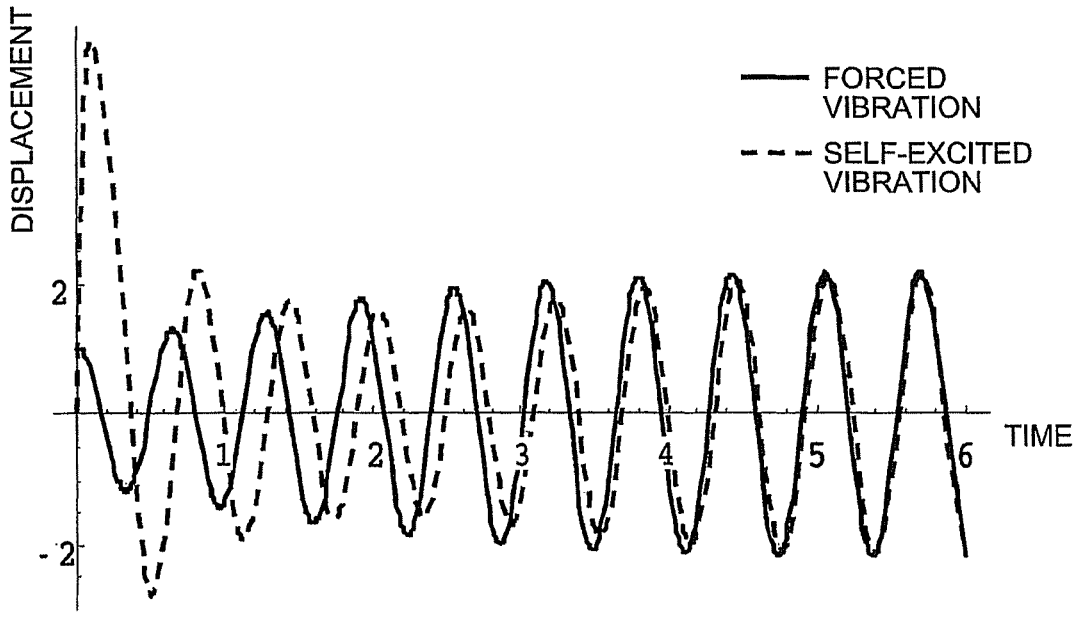
FIGS. 1A and 1B are diagrams to illustrate entrainment (synchronization) in phase and in reverse phase, respectively.

In the following description, "vibration" indicates a movement including "oscillation".

According to one embodiment, an apparatus for loading vibration is provided. The apparatus for loading vibration has a contacting unit, a first vibration unit, a storage unit and a control unit. The contacting unit is capable of coming into contact with a biological body which pulsates or beats in a contact state of a first contact condition. The first vibration unit provides a self-excited vibration to the biological body through the contacting unit. The storage unit stores a second contact condition which synchronizes the self-excited vibration with the pulses or the beats. The control unit controls the contact state of the contacting unit so as to make the first contact condition become closer to the second contact condition.

Hereinafter, further embodiments will be described with reference to the drawings.

In the drawings, the same reference numerals denote the same or similar portions respectively.

Apparatuses for loading vibration according to the embodiments are configured to adjust pulses or beats by using an entrainment (synchronization) described below. The entrainment is generated by providing self-excited vibration to circulatory systems such including ductus arteriosus, ductus venosus, capillary blood vessels (hereinafter collectively referred to as "blood vessels") or lymph vessels which pulsate inside a biological body, or to internal organs such as a heart which beat.

A description described below is made with reference to an example of adjusting pulses of the blood vessels.

When a non-linear phenomenon according to a natural system or a non-natural system, for example, behaviors of a group of self-excited vibrators which interact, or self-excited vibration (limit cycle vibration) in a forcible vibration system satisfies a condition, a phenomenon where frequencies or phases of the vibration synchronize occurs.

A phenomenon where a rhythm of a non-linear vibrator is dragged to another stable rhythm and the former rhythm is synchronized with the stable rhythm is referred to as "entrainment (synchronization)".

The drawing phenomenon includes a frequency entrainment (frequency locking) and a phase entrainment (phase locking). In the frequency entrainment, frequencies are synchronized. In the phase entrainment, not only frequencies but also phases are synchronized. In a case where the frequency of a cyclic forced vibration is $\omega$, and the frequency of the self-vibration is $\Omega$, the following equation is satisfied when a frequency entrainment arises. In the following equation, n and m are integers equal to or greater than one which may be arbitrarily determined in advance.

$$n\cdot\omega=m\cdot\Omega \tag{1}$$

Further, in a case where the phase of the forced vibration is $\phi\mathbf{1}$, and the phase of the self-excited vibration is $\phi\mathbf{2}$, the following equation is satisfied when a phase entrainment arises. In the following equation, the constant X is $\pi/4$, for example. The phase locking is performed within a scope which meets the following equation.

$$|n\cdot\phi_1-m\cdot\phi_2|<X \tag{2}$$

The following description will be made with regard to an example of performing a frequency locking in a case where the integer n=1, the integer m=1, and the phase difference between the forced vibration and the self-excited vibration is 0 (in phase) or $\pi$ (in reverse phase).

Figure 1B:
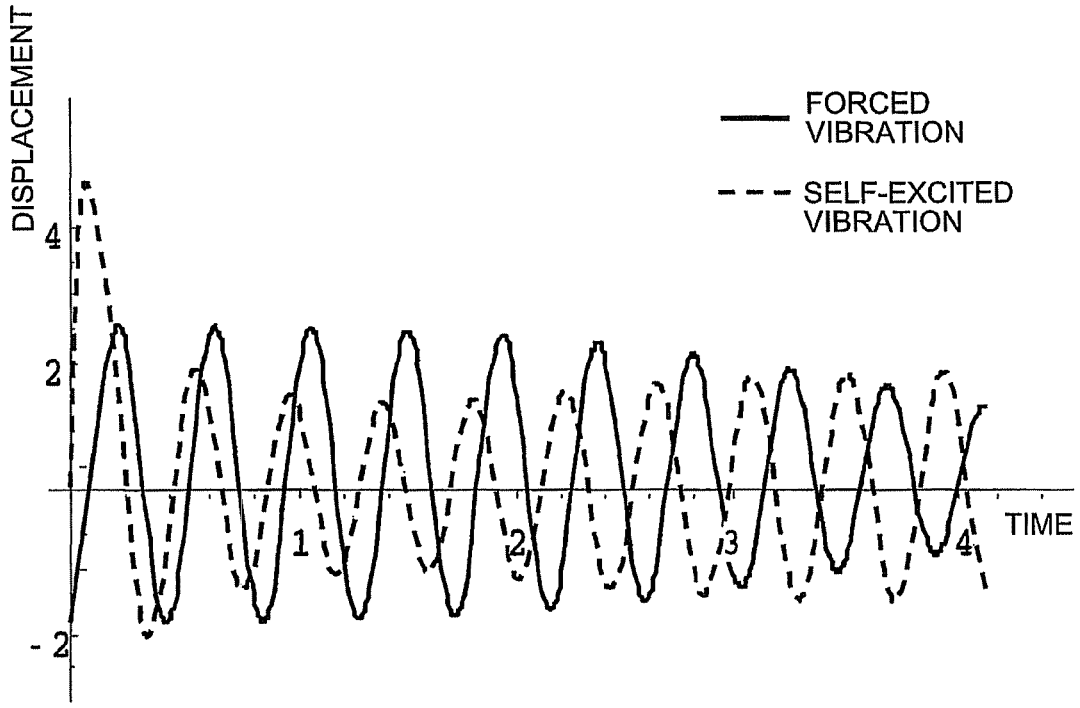

Two kinds of entrainments may occur, and they are an entrainment in phase and an entrainment in reverse phase, as illustrated in FIGS. 1A and 1B. FIG. 1A is a diagram illustrating the entrainment in phase, and FIG. 1B is a diagram illustrating the entrainment in reverse phase.

In the case of the entrainment occurring in phase as illustrated in FIG. 1A, the self-excited vibration and the forced vibration induce entrainment so that the phases match and the frequencies synchronize as time passes. At this time, the amplitude of the forced vibration becomes large.

On the other hand, in the case of the entrainment occurring in reverse phase as illustrated in FIG. 1B, the self-excited vibration and the forced vibration induce entrainment so that the phases deviate by $\pi$ and the frequencies synchronize as time passes. At this time, the amplitude of the forced vibration becomes small.

The following description will be made with regard to a configuration example of a mechanism for loading self-excited vibration which generates a self-excited vibration.

In order to describe a configuration example of the mechanism for loading self-excited vibration, a case where a flutter and a galloping caused by a flowable medium flows around a square cylinder will be explained as an example. The movement of the square cylinder is limited by springs and dashpots so that the square cylinder moves in a direction perpendicular to a flow of the medium.

As to the mechanism for loading self-excited vibration, the mechanical behavior of the square cylinder which provides loads to body tissues may be expressed by the following equation.

$$m\ddot{y}+r\dot{y}+ky=F(\dot{y}) \tag{3}$$

In the following equation, y represents a displacement of the square cylinder. m represents mass of the square cylinder, r represents a viscosity coefficient which shows a dumping in the mechanical behavior of the square cylinder. k represents an elastic coefficient in the mechanical behavior of the square cylinder. In addition, F in the right-hand side represents a driving force for inducing self-excited vibration to the square cylinder.

When the velocity of the square cylinder is $V_1$ and the flow velocity of the medium is $V_2$, the relative velocity of the medium with respect to the square cylinder is represented by $(V_1^2+V_2^2)^{1/2}$. The relative velocity provides the vertical force to the square cylinder as a fluid force. The fluid force is represented by a function of an angle formed by a relative speed and a flow direction of the medium.

At this time, the driving force may approach to the following function form (equation). In the following equation, ρ represents a density of the medium. V represents a flow velocity of the medium. "a" represents an area of a front surface (seen in the flow direction of the medium) of the square cylinder. C represents a fluid force.

$$F(\dot{y}) = \frac{1}{2}\rho V^2 aC = \frac{1}{2}\rho V^2 a\left[A_1\left(\frac{\dot{y}}{v}\right) - A_2\left[\frac{\dot{y}}{V}\right]^3 + A_3\left[\frac{\dot{y}}{V}\right]^5 - A_4\left[\frac{\dot{y}}{V}\right]^7\right] \tag{4}$$

When the form of the square cylinder and the density of the medium are appropriately selected, $A_3=0$ and $A_4=0$ are satisfied. As a result, the driving force of the mechanism which performs the self-excited vibration may be expressed in the form of $C_1$ (=the velocity of the square cylinder)$-C_2$ (=(the velocity of the square cylinder)$^3$), in the example. Accordingly, the equation 3 may be substituted to the following equation.

$$m\ddot{y}+r\dot{y}+ky=C_1(\dot{y})-C_1(\dot{y})^3 \tag{5}$$

Both of the sides of the equation 5 are differentiated with respect to time, and the velocity of the square cylinder is replaces with a new variable y. The above equation with respect to y is represented by a Van Der Pol equation shown as the following equation. In the following equation, α is a load parameter relating to the vibration of the mechanism for loading self-excited vibration.

$$\ddot{y}-\alpha(1-y^2)\dot{y}+y=0 \tag{6}$$

when the forced vibration provided on the self-excited vibration is represented by a periodic function ε sin(ωt), for example, the interaction between the self-excited vibration and the forced vibration is represented by the following equation. In the following equation, ε is an interaction parameter which represents the intensity of the interaction between the forced vibration and the self-excited vibration.

$$\ddot{y}-\alpha(1-y^2)\dot{y}+y=\varepsilon\ \sin(\omega t) \tag{7}$$

The load parameter α and the interaction parameter ε which influence the induction of the entrainment will be described below.

The load parameter α is a parameter relating to the vibration of the mechanism for loading self-excited vibration, and may include the amplitude and the frequency of the vibration generation source (for example, a flutter, a galloping or a piezo-actuator based on vibration) which induces the vibration in the mechanism for loading self-excited vibration.

The interaction parameter ε is a parameter which represents a condition for contacting the body, the characteristics of materials (including the skin of the body) which are interposed between the body tissues and the mechanism for loading self-excited vibration and so on. The parameter may include load-deformation characteristics which the materials have, thicknesses of the materials, and the contact pressure of the mechanism to the body when the mechanism is fixed on the body.

When the solution of Equation 7 is described as y=A(t) sin(ωt+ϕ(t)), the difference Δω between the frequency of the self-excited vibrator and the frequency of the forced vibration is required to satisfy the following equation in order to cause an entrainment.

$$-\varepsilon/(2A)<\Delta\omega<\varepsilon/(2A) \tag{8}$$

The entrainment may be induced by adjusting the load parameter α and the interaction parameter ε which adjusts the intensity of the forced vibration, so as to satisfy the above condition.

At this time, in a case where the interaction parameter ε>0, the self-excited vibration and the forced vibration synchronize in reverse phase (the phase deviates by π). Further, in a case where the interaction parameter ε<0, the self-excited vibration and the forced vibration synchronize in phase when the absolute value of ε is sufficiently smaller than the amplitude of the self-excited vibration, and the self-excited vibration and the forced vibration synchronize in reverse phase when the absolute value of ε is sufficiently larger than the amplitude of the self-excited vibration.

Hereinafter, an apparatus for loading vibration according to a first embodiment will be a described. In the embodiment, the apparatus for loading vibration is applied to a health care apparatus such as a cuff which may be wound around the neck, four limbs, or the trunk of a biological body.

Figure 2:
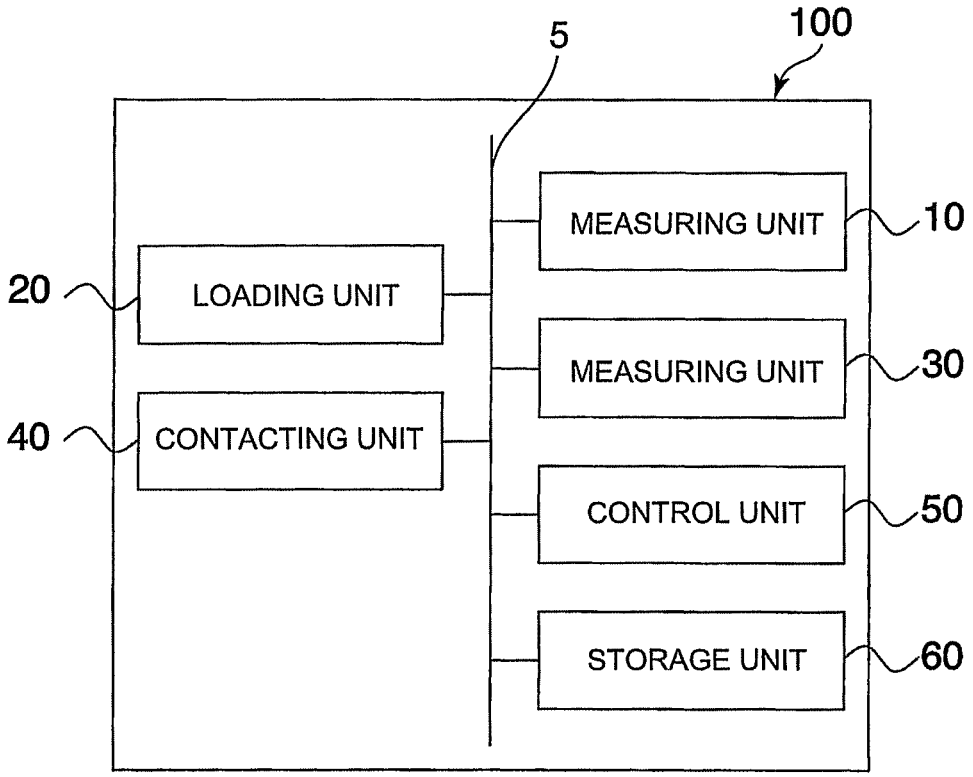
FIG. 2 is a configuration diagram to illustrate an apparatus for loading vibration according to a first embodiment.

FIG. 2 is a configuration diagram illustrating the apparatus for loading vibration according to the first embodiment. An apparatus 100 for loading vibration illustrated in FIG. 2 is provided with a measuring unit 10 as a first measuring unit, a loading unit 20 as a first vibration unit, a measuring unit 30 as a second measuring unit, a contacting unit 40, a control unit 50, and a storage unit 60. The measuring unit 10 measures the pulse rhythm (including the amplitude and the cycle) of the body. The loading unit 20 provides a self-excited vibration to the body under a first load condition. The measuring unit 30 measures the amplitude and the cycle of the self-excited vibration. The contacting unit 40 adjusts a contact state which is a first contact condition between the body and the loading unit 20. The control unit 50 controls an entrainment. The storage unit 60 stores an initial value of a load condition which is a second load condition and an initial value of a contact condition which is a second contact condition. These units 10, 20, 30, 40, 50 and 60 are connected to a signal line 5.

Figure 3A:
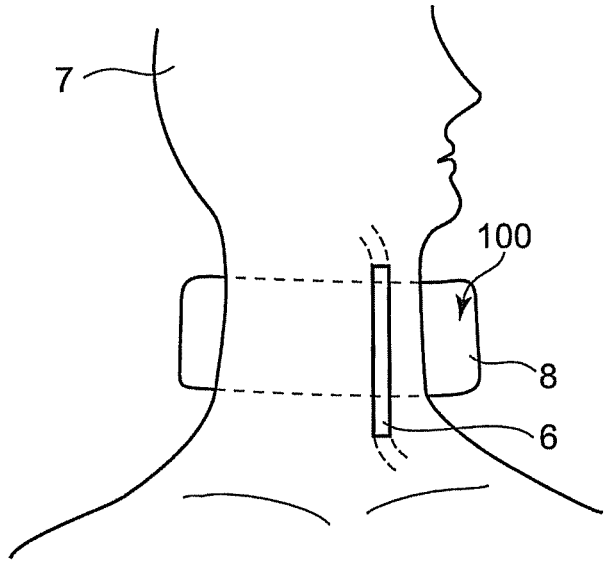
FIGS. 3A and 3B are schematic diagrams to illustrate examples where the apparatus according to the first embodiment is applied to a cuff, respectively.
Figure 3B:
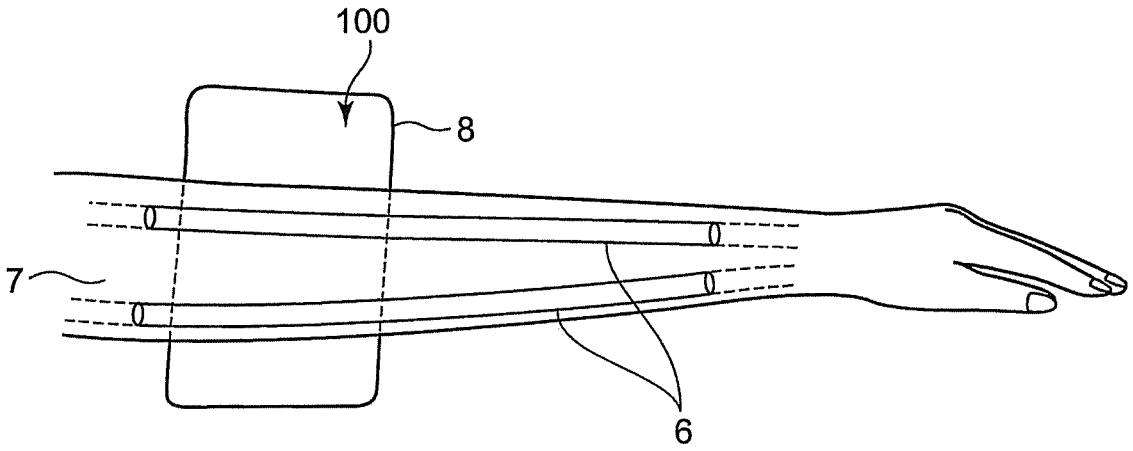

A computing device such as a CPU or an MPU is used for the measuring unit 30 and the control unit 50. A storage device such as a memory or an HDD is used for the storage unit 60. FIGS. 3A and 3B are schematic diagrams illustrating examples of the apparatus 100 for loading vibration which are applied to cuffs.

The measuring unit 10 measures pulse waveforms when the blood vessels pulsate. The pulse waveforms may be the amplitude of the pulse wave and the number or the cycle of the vibration per sampling cycle. For the measuring unit 10, a sphygmomanometer or a pulse beat sensor may be used. In a case of using a sphygmomanometer, the sphygmomanometer may be provided in a cuff 8 which may be wound around the neck, the four limbs, or the trunk of the body 7, which has blood vessels 6, as illustrated in FIG. 3A or 3B. In a case of using a pulse beat sensor, the pulse beat sensor includes a reference light generating source and a reference light receiving unit which can be attached to the skin surface just above the artery of the body 7. The embodiment will be described with regard to the case of using the sphygmomanometer as the measuring unit 10.

In general, a blood pressure waveform and a pulse waveform to be obtained by a sphygmomanometer have a relation of almost the same phase, approximately. For the purpose of simplicity, the blood pressure waveform and the pulse waveform are deemed to be a sine wave or a cosine wave. Accordingly, the measuring unit 10 can measure the amplitude and the cycle of the pulse waveform by measuring the amplitude and the cycle of the blood pressure waveform, indirectly. The measured values of the amplitude and the cycle can be stored in the storage unit 60.

The loading unit 20 is an actuator which loads a self-excited vibration on the body by the contacting unit 40. The self-excited vibration may be a self-excited vibration of a Van Der Pol type. The loading unit 20 performs self-excited vibration by applying command voltage which is calculated by the control unit 50. According to the embodiment, the loading unit 20 is provided in the cuff, and loads the self-excited vibration on the body in such a manner that the cuff is wound around an arm of the body.

Hereinafter, the specific configuration of the loading unit 20 will be described. A plurality of beams is provided inside the cuff. One ends of the beams are fixed to supporting members and the other ends of beams are free ends. A piezoelectric element is formed at one side of each beam. When a voltage is applied to the piezoelectric element, the piezoelectric element shrinks or stretches so that a flexure of the beam occurs. The distance r from the supporting member of the beam to the leading end is set to 1 (r=1). Hereinafter, the flexure of the beam when the distance r is 1 is referred to as a displacement.

The measuring unit 30 measures the amplitude and the cycle of the vibration from the loading unit 20. The measuring unit 30 obtains a value of the amplitude from a relation between the displacement and a voltage applied to the piezoelectric element of the loading unit 20, for example. Further, the measuring unit 30 can obtain a value of the cycle of the vibration from the cycle of the applied voltage, which is provided from the control unit 50 as described below.

The contacting unit 40 is a member which is provided between the loading unit 20 and the body and which adjusts the contact state which influences the interaction parameter ε. In the embodiment, the contacting unit 40 adjusts the contact pressure (pressure force) onto the body by increasing the volume. The increasing of the volume is performed by introducing the air, for example. At this time, the contact state of the contacting unit 40 is controlled by the control unit 50 as described below.

The control unit 50 calculates an input voltage Vc to be supplied to the loading unit 20.

According to the self-excited vibration of the Van Der Pol type, the effect of the vibration or the displacement of the loading unit 20 functions as an acceleration input to the displacement of the cantilever beam. Further, the self-excited vibration has a characteristic that the displacement by the shrinkage or the stretch of an integral type piezoelectric element is nearly proportional to an applied voltage. Accordingly, the control unit 50 feeds back the linear combination of the integrated value of the displacement of the beam with the cubed integrated value of the displacement of the beam, and calculates the input voltage Vc which is supplied to the loading unit 20 as shown in the following equation. As an initial condition, predetermined voltage values stored in the storage unit 60 in advance may be used.

$$V_c = K_{lin}\int \delta|_{r=1}dt - K_{non}\int \delta^3|_{r=1}dt \tag{9}$$

In the above equation, Klin and Knon are a linear feedback gain and a non-linear feedback gain, for example, respectively. In the embodiment, the feedback gains Klin, Knon are values which influence the load parameter α, and the initial values of the feedback gains Klin and Knon are stored in the storage unit 60 in advance. δ|r=1 is a displacement in a case of r=1 with respect to the loading unit 20. As the displacement, an amplitude value obtained from the measuring unit 30 may be used.

In order to induce synchronization of the biological rhythm and the self-excited vibration of the loading unit 20 easily, it is desirable that the feedback gains Klin, Knon be set such that the frequency of the self-excited vibration is a value close to the frequency of the biological rhythm, for example, within ±10%.

The control unit 50 obtains the cycle value of the biological rhythm measured by the measuring unit 10 and the cycle value of the self-excited vibration measured by the measuring unit 30. The obtained cycle values are converted to the frequencies, respectively. When a ratio (hereinafter referred to as "error") of a deviation of the frequency of the self-excited vibration from the frequency of the biological rhythm to the latter frequency is not within the range of ±10%, the feedback gains Klin and Knon are changed so as to make the frequency of the self-excited vibration become closer to the frequency of the biological rhythm.

When a measurement error arises in measuring the biological rhythm, a variation distribution of the frequency is measured, and the feedback gains Klin, Knon are changed so as to become closer to the average value of the variation distribution of the frequency.

Further, the control unit 50 controls the operation of the contacting unit 40 so that the biological rhythm and the self-excited vibration of the loading unit 20 are synchronized. By the control, the control unit 50 changes the contact state in which the loading unit 20 contacts the body.

When the biological rhythm and the self-excited vibration of the loading unit 20 are synchronized in phase, the amplitude of the biological rhythm (forced vibration) increases with time as illustrated in FIG. 1A. In addition, in s case of synchronization in reverse phase, the amplitude of the biological rhythm decreases with time as illustrated in FIG. 1B.

The control unit 50 calculates the amplitude difference of the pulse waveform per sampling cycle by using the amplitude of the pulse waveform (blood pressure waveform) measured by the measuring unit 10.

For example, when a user selects to synchronize the biological rhythm and the self-excited vibration of the loading unit 20 in phase by a controller (not illustrated in FIG. 2), the control unit 50 controls the contacting unit 40 so as to increase the amplitude of the pulse waveform more to change the contact pressure on the body or to change the load condition of the loading unit 20. When the user selects to synchronize the biological rhythm and the self-excited vibration of the loading unit 20 in reverse phase, the control unit 50 controls the contacting unit 40 so as to decrease the amplitude of the pulse waveform more to change the contact pressure on the body or to change the load condition of the loading unit 20.

The control unit 50 compares the amplitude difference of the pulse waveform with a threshold value stored in the storage unit 60 in advance. When the amplitude is equal to or less than the threshold value, the control unit 50 determines that the biological rhythm and the self-excited vibration of the loading unit 20 are synchronized. After the determination, the control unit 50 controls the contact pressure of the contacting unit 40 such that the contact pressure is constant.

The storage unit 60 stores the initial values of the load condition and the contact condition. As the initial values, values which synchronize the biological rhythm with the self-excited vibration may be obtained by simulations or experiments in advance and stored in the storage unit 60.

A distribution relating to substance deformation characteristics such as stress, twist and deformation of blood vessel walls and subcutaneous tissues of the body may be prepared in advance. Using the distribution, observation variables such as a response (a displacement and a pressure) from the skin surface of the body, the blood flow waveform and the blood pressure waveform, and the load parameter $\alpha$ (a residual stress, an unstressed state, an external force etc.) and the interaction parameter $\varepsilon$ (a pressure etc.) respectively serving as intermediate variables (latent variable) may be identified by a statistical method such as a hierarchical Bayesian model & Markov Chain Monte Carlo method or a particle filter method.

In order to induce the entrainment, a condition in which the load parameter $\alpha$ and the interaction parameter $\varepsilon$ are satisfied is obtained from the equations 5, 8. In the embodiment, the relation between the cuff pressure and the load parameter $\alpha$ and the interaction parameter $\varepsilon$ which satisfy the equations 5, 8 is obtained by experiments etc. in advance. The value of the cuff pressure is stored in the storage unit 60.

Figure 4:
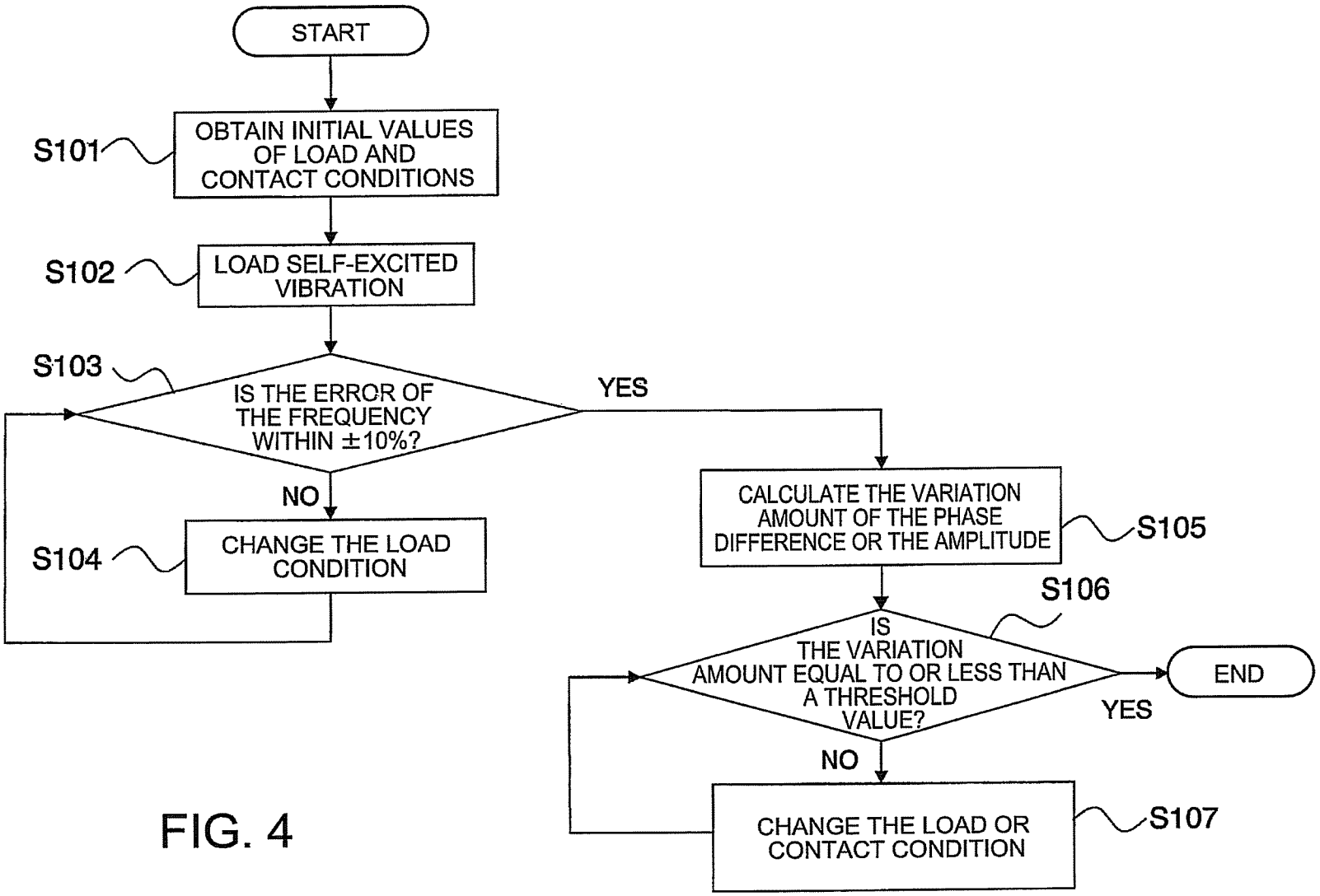
FIG. 4 is a flowchart to illustrate an operation of the apparatus according to the first embodiment.

Hereinafter, an operation of the apparatus 100 for loading vibration will be described with reference to the flowchart illustrated in FIG. 4.

The control unit 50 illustrated in FIG. 2 reads out the initial values of the load condition i.e. the feedback gains Klin, Knon and the initial value of the contact condition i.e. the contact pressure of the contacting unit 40 from the storage unit 60 (S101).

The control unit 50 calculates the input voltage Vc based on the equation 9 and applies the calculated input voltage Vc to the loading unit 20. By applying the calculated input voltage Vc, the loading unit 20 generates self-excited vibration and loads the generated self-excited vibration on the body (S102).

The cycle of the biological rhythm is obtained from the measuring unit 10, and the cycle of the self-excited vibration is obtained from the measuring unit 30. The values of the cycles are stored in the storage unit 60. The control unit 50 converts the values of the cycles stored in the storage unit 60 into respective frequencies. Further, it is determined whether or not the error of the frequency of the self-excited vibration with respect to the frequency of the biological rhythm is within ±10% (S103).

When the error of the frequency is not within ±10%, the control unit 50 changes the load condition so as to make the error of the frequency become within ±10%. In other word, the control unit 50 changes the load condition so as to make the frequency of the self-excited vibration become closer to the frequency of the biological rhythm (S104). When the difference between the frequencies is within ±10%, the load condition is constantly maintained.

When the error of the frequency is within ±10%, the control unit 50 obtains the amplitude of the biological rhythm from the storage unit 60 sequentially, and calculates the variation amount of the amplitude i.e. the amplitude difference (S105). The control unit 50 determines whether or not the amplitude difference is equal to or less than a predetermined threshold value (S106).

When the i.e. the amplitude difference is not equal to or less than the predetermined threshold value, the control unit 50 changes the load condition or the contact condition so as to decrease the i.e. the amplitude difference of the biological rhythm more, i.e., so that the biological rhythm and the self-excited vibration are synchronized (S107). When the variation amount of the amplitude i.e. i.e. the amplitude difference is equal to or less than the predetermined threshold value, the contact condition is maintained to become constant.

The apparatus for loading vibration according to the embodiment allows the mechanical behavior inside the body to approach an appropriate range. In addition, the control unit 50 can induce an entrainment despite the differences of bodies by controlling the contacting unit 40 so as to make the biological rhythm synchronized with the self-excited vibration of the loading unit 20.

As illustrated in FIG. 1, when an entrainment is induced, the phase difference between the self-excited vibration and the biological rhythm (a forced vibration) approaches a constant value, and the variation amount of the phase difference decreases.

The control unit 50 of the vibration loading apparatus may calculate the variation amount of the phase difference between the pulse waveform and the self-excited vibration per sampling cycle by using the amplitude and the cycle of the pulse waveform (a blood pressure waveform) and the amplitude and the cycle of the self-excited vibration.

When a user selects synchronization in phase by a controller (not illustrated in FIG. 2) etc., the contacting unit 40 can be controlled so that the amplitude of the pulse waveform increases and so that the variation amount of the phase difference decreases. By the control, the pressure on the body can be changed. When the user selects synchronization in reverse phase, the contacting unit 40 is controlled so that the amplitude of the pulse waveform decreases and so that the variation amount of the phase difference decreases, and, by the control, the pressure on the body can be changed.

As described above, the entrainment can be induced more accurately by using the variation amount of the phase difference and the variation amount of the amplitude i.e. the amplitude difference.

A second embodiment will be described below. There is a phenomenon where the drawing occurs most easily at optimum noise intensity. The phenomenon is called as a stochastic resonance or a stochastic synchronization. This is a phenomenon where vibrations are synchronized at optimum noise intensity when a noise is added to a non-linear system, or where a cycle or phase is drawn to an average cycle when an appropriate noise external force is added to a group of vibrators which have slightly different vibration cycles or phases.

Figure 5:
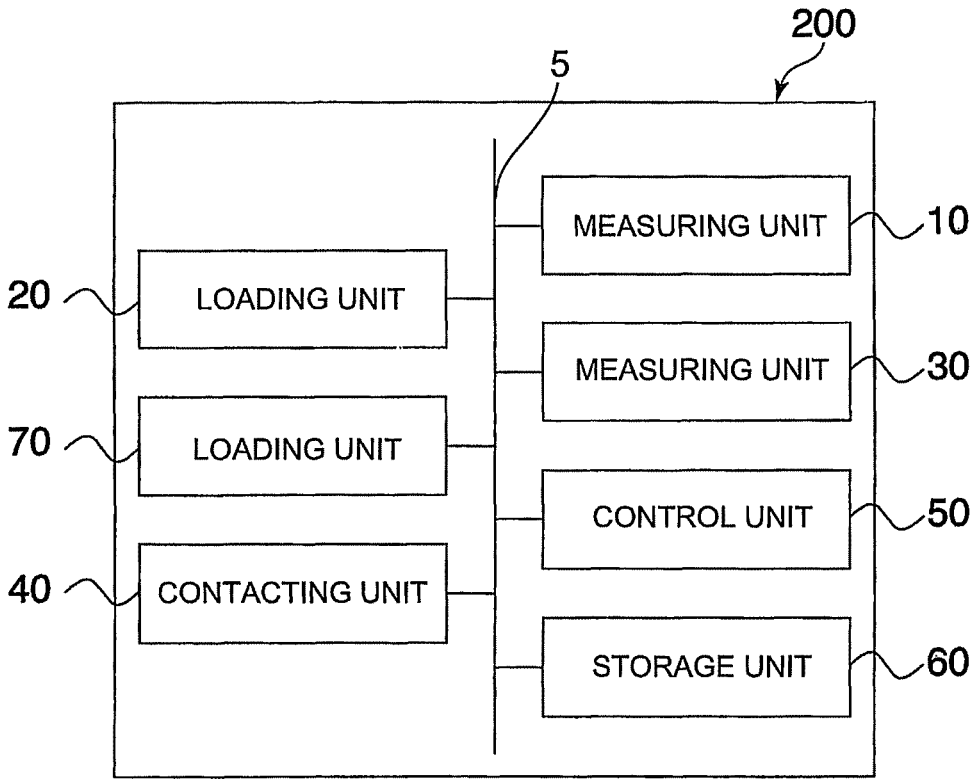
FIG. 5 is a configuration diagram to illustrate an apparatus for loading vibration according to a second embodiment.

FIG. 5 shows a configuration of an apparatus 200 for loading vibration according to the second, embodiment. The apparatus 200 is further provided with a loading unit 70 as a second vibration unit.

The loading unit 70 is an actuator which loads a minute vibration (disturbance) on a biological body. For example, the loading unit 70 is provided in a cuff, and loads a minute vibration by winding the cuff around an arm of the body.

As the loading unit 70, a piezo-actuator or an ultrasonic actuator which has a random noise for providing amplitude or an load may be used. In the embodiment, a vibration having amplitude which is equal to or less than one-third of amplitude of self-excited vibration from a loading unit 20 is defined as the minute vibration. The loading unit 70 is provided near the loading unit 20 in order to induce a stochastic resonance phenomenon, desirably.

The above apparatus for loading vibration according to the second embodiment can make the mechanical behavior inside the body approach to an appropriate range. Further, it is possible to induce an entrainment despite differences of biological bodies by using the stochastic resonance phenomenon.

Figure 6A:
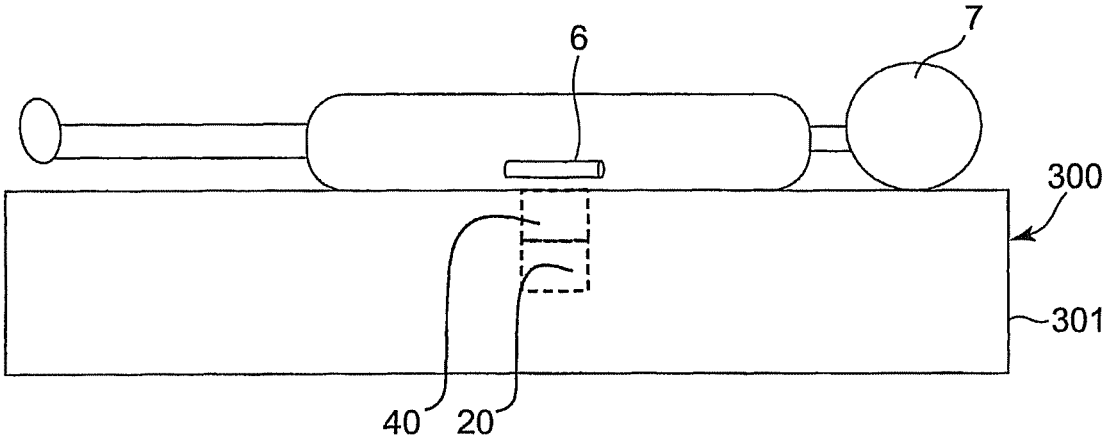
FIGS. 6A and 6B are diagrams to illustrate apparatuses for loading vibration according to modified embodiments, respectively.
Figure 6B:
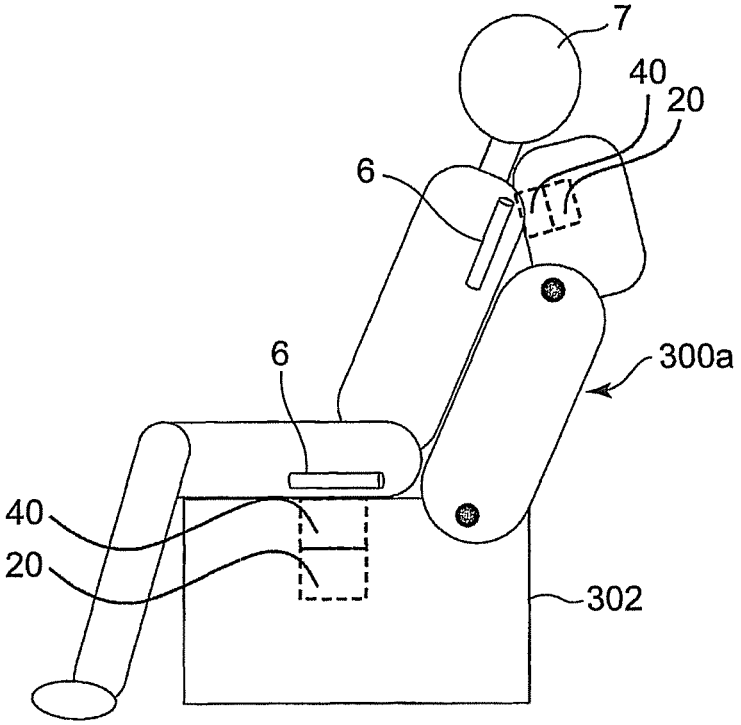

The embodiments described above show the case where the apparatuses for loading vibration are applied to the cuff. The apparatuses may be applied to other healthcare devices. FIGS. 6A and 6B are diagrams illustrating apparatuses for loading vibration according to modified embodiments respectively. FIG. 6A is a diagram illustrating an apparatus 300 for loading vibration applied to a bed, and FIG. 6B is a diagram illustrating an apparatus 300*a* for loading vibration applied to a sofa.

The apparatus 300 illustrated in FIG. 6A has a loading unit 20 and a contacting unit 40 provided inside a mattress 301 of a bed so that the contacting unit 40 can contact a body 7 having blood vessels 6. A plurality of loading units and a plurality of contacting units may be provided inside the mattress 301 along a surface of the mattress 301. Further, the loading units 20 and the contacting units 40 may be provided movably inside the mattress 301. In this case, a technology known in the art may be used for a movement mechanism.

The apparatus 300*a* illustrated in FIG. 6B has loading units 20 and contacting units 40 provided inside a seating surface and a backrest of a sofa 302 respectively so that the contacting unit 40 can contact a body 7 having blood vessels 6. A plurality of loading units and a plurality of contacting units may be provided on each of the seating surface and the backrest. The loading unit 20 and the contacting units 40 may be provided movably inside the seating surface and the backrest. Further, an additional loading unit and an additional contacting unit may be provided inside an armrest or a footrest (not illustrated in FIG. 6B).

The apparatuses of the embodiments described above can change the mechanical behavior inside the body.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for loading vibration, comprising:

a contact adjuster capable of coming into contact with a biological body which pulsates or beats in a contact state of a first contact condition;

a first vibrator which is a non-linear vibrator and is configured to provide a self-excited vibration to the biological body through the contact adjuster;

a storage device configured to store a second contact condition which synchronizes the pulses or the beats with the self-excited vibration; and a controller configured to control the contact adjuster to adjust the contact state so as to make the first contact condition become closer to the second contact condition, wherein the controller includes a calculating unit which obtains an amplitude and/or phase of the pulsates or beats and the amplitude and/or phase of the self-excited vibration and calculates an amplitude and/or phase variation amount;

a determining unit which determines whether or not the amplitude and/or phase variation amount is equal to or less than a predetermined threshold value; and a controlling unit which controls the contact adjuster to change the first contact condition so as to decrease the amplitude and/or phase variation amount when the amplitude and/or phase difference is not equal to or less than the predetermined threshold value, and a difference $\Delta\omega$ between a frequency of the first vibrator and a frequency of the pulsates or beats satisfies the following equation in order to cause an entrainment where A is an amplitude of the pulses or the beats and $\varepsilon$ is an interaction parameter showing the first contact condition for adjusting the intensity of the pulses or the beats, and $$-\varepsilon/(2A)<\Delta\omega<\varepsilon/(2A).$$

2. The apparatus according to claim 1, further comprising a first measuring instrument configured to measure amplitude of the pulses or the beats, wherein the second contact condition is a condition where the pulses or the beats are synchronized with the self-excited vibration in phase, and the controller controls the contact state so as to increase the amplitude measured by the first measuring instrument.

3. The apparatus according to claim 2, further comprising a second measuring instrument configured to measure a cycle of the self-excited vibration, wherein the first measuring instrument further measures a cycle of the pulses or the beats, the controller uses the cycle of the pulses or the beats measured by the first measuring instrument and the cycle of the self-excited vibration measured by the second measuring instrument to calculate a phase difference between the self-excited vibration and the pulses or the beats, and the controller controls the contact state so as to decrease an amount of the phase difference to synchronize the pulses or beats with the self-excited vibration.

4. The apparatus according to claim 2, further comprising a second vibrator configured to provide a minute vibration to the biological body through the contact adjuster.

5. The apparatus according to claim 1, further comprising a first measuring instrument configured to measure amplitude of the pulses or the beats, wherein the second contact condition is a condition where the pulses or the beats are synchronized with the self-excited vibration in reverse phase, and the controller controls the contact state so as to decrease the amplitude measured by the first measuring instrument.

6. The apparatus according to claim 5, further comprising a second measuring instrument configured to measure a cycle of the self-excited vibration, wherein the first measuring instrument further measures a cycle of the pulses or the beats, the controller uses the cycle of the pulses or the beats measured by the first measuring instrument and the cycle of the self-excited vibration measured by the second measuring instrument to calculate a phase difference between the self-excited vibration and the pulses or the beats.

7. The apparatus according to claim 5, further comprising a second vibrator configured to provide a minute vibration to the biological body through the contact adjuster.

8. The apparatus according to claim 1, further comprising a second vibrator configured to provide a minute vibration to the biological body through the contact adjuster.

9. The apparatus according to claim 1, wherein the controller induces an entrainment from a phase of pulses or beats of the biological body to a phase of the self-excited vibration of the first vibrator.

10. The apparatus according to claim 9, wherein the entrainment is induced by making the controller control a load parameter of the first vibrator and an interaction parameter showing a contact condition between the biological body and the contact adjuster.

11. The apparatus according to claim 1, wherein the pulses or the beats to be adjusted by the apparatus are those of blood vessels, lymph vessels or internal organs of the biological body.

12. The apparatus according to claim 1, wherein the first vibrator provides a frequency of the self-excited vibration expressed by the following equation, when the frequency of the pulses or the beats is ω and the frequency of the self-excited vibration is Ω in the following equation, where n and m are integers equal to or greater than one:

$$n \cdot \omega = m \cdot \Omega.$$

13. The apparatus according to claim 1, wherein the first vibrator provides a phase of the self-excited vibration expressed by the following equation, when the phase of the pulses or the beats is $\phi_1$ and the phase of the self-excited vibration is $\phi_2$, where n and m are integers equal to or greater than one and X is a constant value:

$$|n \cdot \phi_1 - m \cdot \phi_2| < X.$$

14. An apparatus for loading vibration, comprising:

a contact adjuster capable of coming into contact with a biological body which pulsates or beats in a contact state of a first contact condition;

a first vibrator which is a non-linear vibrator and is configured to provide a self-excited vibration to the biological body through the contact adjuster in a first load condition;

a storage device configured to store a second load condition or a second contact condition where the pulses or the beats are synchronized with the self-excited vibration; and a controller configured to control the first vibrator so as to make the first load condition become closer to the second load condition or to control the contact adjuster to adjust the contact state to make the first contact condition become closer to the second contact condition, wherein the controller includes a first calculating unit which obtains a frequency of the pulsates or beats and a frequency of the self-excited vibration and calculates a frequency difference, a first determining unit which determines whether or not the frequency difference is equal to or less than a predetermined threshold value, a first controlling unit which changes the first load condition so as to decrease the frequency difference when the frequency difference is not equal to or less than the predetermined threshold value, a second calculating unit which obtains an amplitude and/or phase of the pulsates or beats and an amplitude and/or phase of the self-excited vibration and calculates an amplitude and/or phase variation amount, a second determining unit which determines whether or not the amplitude and/or phase variation amount is equal to or less than a predetermined threshold value, and a second controlling unit which controls the contact adjuster to change the first contact condition so as to decrease the amplitude and/or phase variation amount when the amplitude and/or phase variation amount is not equal to or less than the predetermined threshold value, and the difference Δω between the frequency of the first vibrator and the frequency of the pulsates or beats satisfies the following equation in order to cause an entrainment where A is an amplitude of the pulses or the beats and ε is an interaction parameter showing the first contact condition for adjusting the intensity of the pulses or the beats, and $$-\varepsilon/(2A) < \Delta\omega < \varepsilon/(2A).$$

15. The apparatus according to claim 14, further comprising a first measuring instrument configured to measure amplitude of the pulses or the beats, wherein the second contact condition or the second load condition is a condition where the pulses or the beats are synchronized with the self-excited vibration in phase, and the controller controls the contact state or the first load condition so as to increase the amplitude measured by the first measuring instrument.

16. The apparatus according to claim 15, further comprising a second measuring instrument configured to measure a cycle of the self-excited vibration, wherein the first measuring instrument further measures a cycle of the pulses or the beats, the controller uses the cycle of the pulses or the beats measured by the first measuring instrument and the cycle of the self-excited vibration measured by the second measuring instrument to calculate the phase difference between the self-excited vibration and the pulses or the beats, and the controller controls the contact state so as to decrease an amount of the phase difference.

17. The apparatus according to claim 15, further comprising a second vibrator configured to provide a minute vibration to the biological body through the contact adjuster.

18. The apparatus according to claim 14, further comprising a first measuring instrument configured to measure amplitude of the pulses or the beats, wherein the second contact condition or the second load condition is a condition where the pulses or the beats are synchronized with the self-excited vibration in reverse phase, and the controller controls the contact state or the first load condition so as to decrease the amplitude measured by the first measuring instrument.

19. The apparatus according to claim 18, further comprising a second measuring instrument configured to measure a cycle of the self-excited vibration, wherein the first measuring instrument further measures a cycle of the pulses or the beats, the controller uses the cycle of the pulses or the beats measured by the first measuring instrument and the cycle of the self-excited vibration measured by the second measuring instrument to calculate the phase difference between the self-excited vibration and the pulses or the beats.

20. The apparatus according to claim 18, further comprising a second vibrator configured to provide a minute vibration to the biological body through the contact adjuster.

21. The apparatus according to claim 14, further comprising a second vibrator configured to provide a minute vibration to the biological body through the contact adjuster.

22. The apparatus according to claim 14, wherein the controller induces an entrainment from a phase of pulses or beats of the biological body to a phase of the self-excited vibration of the first vibrator.

23. The apparatus according to claim 22, wherein the entrainment is induced by making the controller control a load parameter of the first vibrator and an interaction parameter showing a contact condition between the biological body and the contact adjuster.

24. The apparatus according to claim 14, wherein the pulses or the beats to be adjusted by the apparatus are those of blood vessels, lymph vessels or internal organs of the biological body.

25. The apparatus according to claim 14, wherein the first vibrator provides a frequency of the self-excited vibration expressed by the following equation, when the frequency of the pulses or the beats is ω and the frequency of the self-excited vibration is Ω in the following equation, where n and m are integers equal to or greater than one:

$$n \cdot \omega = m \cdot \Omega.$$

26. The apparatus according to claim 14, wherein the first vibrator provides a phase of the self-excited vibration expressed by the following equation, when the phase of the pulses or the beats is $\phi_1$ the phase of the self-excited vibration is $\phi_2$, where n and m are integers equal to or greater than one and X is a constant value:

$$|n \cdot \phi_1 - m \cdot \phi_2| < X.$$

* * * * *